US011022414B2

(12) United States Patent
Koehler et al.

(10) Patent No.: US 11,022,414 B2
(45) Date of Patent: Jun. 1, 2021

(54) TRIGGERING DEVICE WITH SAFETY VALVE AND LINKAGE

(71) Applicant: Raytheon Company, Waltham, MA (US)

(72) Inventors: Frederick B. Koehler, Tucson, AZ (US); Paul A. Merems, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 16/585,922

(22) Filed: Sep. 27, 2019

(65) Prior Publication Data

US 2021/0095942 A1 Apr. 1, 2021

(51) Int. Cl.

| | |
|---|---|
| ***F42C 15/34*** | (2006.01) |
| ***F42C 15/36*** | (2006.01) |
| ***F42C 15/20*** | (2006.01) |

(52) U.S. Cl.

CPC ..... *F42C 15/34* (2013.01); *F42C 15/20* (2013.01); *F42C 15/36* (2013.01)

(58) Field of Classification Search

CPC ..... F42C 15/18; F42C 15/184; F42C 15/188; F42C 15/192; F42B 39/20

See application file for complete search history.

(56) References Cited

U.S. PATENT DOCUMENTS

| | | | | |
|---|---|---|---|---|
| 2,920,561 A * | 1/1960 | Berlin | F42B 12/50 | 102/369 |
| 3,735,703 A * | 5/1973 | Bayer | F42C 7/00 | 102/416 |
| 4,311,097 A * | 1/1982 | Backstein | F42C 15/44 | 102/229 |
| 4,483,250 A * | 11/1984 | Thurston | F42C 15/34 | 102/254 |

(Continued)

FOREIGN PATENT DOCUMENTS

GB 823913 11/1959

OTHER PUBLICATIONS

International Search Report and Written Opinion dated Dec. 10, 2020 for corresponding International Application No. PCT/US2020/052663.

*Primary Examiner* — Joshua T Semick

(74) *Attorney, Agent, or Firm* — Renner, Otto, Boisselle & Sklar, LLP

(57) ABSTRACT

A heat-activated triggering device, such as for a missile or munition, includes a firing pin that is driven into a primer, to initiate a detonation and/or combustion reaction. The firing pin may be mechanically coupled to a linkage that prevents egress of output from the primer if the firing pin has not been moved. The linkage may include, for example, a cylindrical valve element with a through hole, the through hole being alignable with an output channel from the primer when the firing pin has been moved sufficiently. The movement of the firing pin slides a dowel pin that is attached to (Continued)

the firing pin. This in turn translates a cam element that turns the cylindrical element. Partial movement of the firing pin still may leave the valve closed. Preventing the primer from prematurely operating to trigger explosion, for example preventing full operation due to a primer being heated.

15 Claims, 4 Drawing Sheets

(56) References Cited

U.S. PATENT DOCUMENTS

| | | | | | |
|---|---|---|---|---|---|
| 4,487,126 | A * | 12/1984 | Schaper | F42C 15/44 | 102/229 |
| 4,535,695 | A * | 8/1985 | Winterhalter | F42C 15/23 | 102/238 |
| 4,739,706 | A * | 4/1988 | Golay | F42C 15/192 | 102/251 |
| 4,843,965 | A * | 7/1989 | Dupuy | F42B 39/20 | 102/481 |
| 5,445,077 | A * | 8/1995 | Merzals | F42B 39/20 | 102/205 |
| 7,055,436 | B2 * | 6/2006 | Glatthaar | F42C 15/31 | 102/221 |
| 7,117,796 | B1 | 10/2006 | Bogle | | |
| 7,530,313 | B2 | 5/2009 | Chamlee | | |
| 8,418,455 | B2 | 4/2013 | Lyman | | |
| 8,789,366 | B2 | 7/2014 | Lyman | | |
| 9,334,675 | B2 | 5/2016 | Koehler | | |
| 9,470,213 | B2 | 10/2016 | Koehler | | |
| 9,611,838 | B2 | 4/2017 | Koehler | | |
| 9,696,125 | B2 * | 7/2017 | Merems | F42C 15/20 | |
| 9,851,190 | B2 | 12/2017 | Andersson | | |
| 2017/0016706 | A1 | 1/2017 | Merems | | |
| 2019/0249970 | A1 | 8/2019 | Wilson | | |

* cited by examiner

TRIGGERING DEVICE WITH SAFETY VALVE AND LINKAGE

FIELD OF THE INVENTION

The invention is in the field of triggering devices, such as for triggering explosive charges.

DESCRIPTION OF THE RELATED ART

One concern with munitions is behavior of stored munitions in the case of fire or environmental thermal runaway. It is desirable to have a safety mechanism to prevent problems in slow cook-off, where the temperature rises in the munition, for example to prevent a rocket motor from being activated to propel a missile in such a circumstance.

SUMMARY OF THE INVENTION

A heat-activated triggering device includes a valve that selective blocks or allows passage through an outlet passage used for travel of hot products from detonation/combustion of a primer and booster.

A heat-activated triggering device includes a valve that is mechanically coupled by a linkage to a firing pin. The valve acts as a safety device for a primer and booster configured to expel detonation products from the trigger device, ensuring that the products exit the device only if the firing pin has move sufficiently to impact the primer.

According to an aspect of the invention, a triggering device includes: a firing pin configured to impact a primer; and a valve mechanically coupled to the firing pin, wherein the valve selectively allows output from firing of the primer pass to an output port of the triggering device.

According to an embodiment of any paragraph(s) of this summary, the valve is a barrel valve, with a through hole that selectively lines up with a passage between the firing pin and the output port.

According to an embodiment of any paragraph(s) of this summary, the barrel valve rotates to align with the passage just as the firing pin reaches the primer.

According to an embodiment of any paragraph(s) of this summary, a linkage mechanically couples the valve to the firing pin.

According to an embodiment of any paragraph(s) of this summary, the linkage includes a linking member that translates along with the firing pin, and a cam mechanism that converts translation of the linking member to rotation of the barrel valve.

According to an embodiment of any paragraph(s) of this summary, the linkage further includes a dowel pin coupling together firing pin and the linking member.

According to an embodiment of any paragraph(s) of this summary, the linking member has a slot therein that receives a follower of the barrel valve.

According to an embodiment of any paragraph(s) of this summary, the slot is substantially parallel to a direction of travel of the linking member.

According to an embodiment of any paragraph(s) of this summary, the triggering device further comprises a casing that defines cavities that are parallel to one another.

According to an embodiment of any paragraph(s) of this summary, the linking member and the firing pin move in respective of the cavities.

According to an embodiment of any paragraph(s) of this summary, the triggering device further includes a lockout configured to selectively prevent movement of the firing pin.

According to an embodiment of any paragraph(s) of this summary, the lockout includes an inertial mass that moves in a recess coaxial with a recess in which the linking member is located.

According to an embodiment of any paragraph(s) of this summary, the triggering device is part of a munition, with the triggering device operatively coupled to a shaped charge of the munition such that detonation products from a primer of the triggering device that is operatively coupled to the firing pin, detonate the shaped charge.

According to another aspect of the invention, a method of operating a triggering device, includes the steps of: moving a firing pin toward a primer; and rotating a barrel valve while the firing pin is moving, through the action of a linkage mechanically coupling the firing pin and the barrel valve.

According to an embodiment of any paragraph(s) of this summary, a through hole of the barrel valve aligns with an output passage to an outlet port of the device, as the firing pin reaches the primer.

According to an embodiment of any paragraph(s) of this summary, the method further includes expelling output from firing of the primer through the outlet port.

According to an embodiment of any paragraph(s) of this summary, the rotating the barrel valve includes a follower on the barrel valve moving in a slot of a linking member that translates along with the firing pin.

According to an embodiment of any paragraph(s) of this summary, the linking member and the firing pin translate in respective passages of a housing of the triggering device, with moving of the firing pin moving a the linking member and a dowel pin that connects together the firing pin and the linking member.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A heat-activated triggering device, such as for a missile or munition, includes a firing pin that is driven into a primer, to initiate a detonation and/or combustion reaction. The firing pin may be mechanically coupled to a linkage that prevents egress of output from the primer if the firing pin has not been moved. The linkage may include, for example, a cylindrical valve element with a through hole, the through hole being alignable with an output channel from the primer when the firing pin has been moved sufficiently. The movement of the firing pin slides a dowel pin that is attached to the firing pin. This in turn translates a cam element that turns the cylindrical element. Partial movement of the firing pin still may leave the valve closed. Preventing the primer from prematurely operating to trigger explosion, for example preventing full operation due to a primer being heated.

The movement of the firing pin may be effected in one embodiment by a bi-metal trigger element, with a breakable pin of a first metal surrounded by a sleeve made of a second metal that is different than the first metal. The sleeve may be made of a shape memory alloy, such as a single-crystal shape memory alloy, that is pre-compresses around part of the pin. The sleeve may be configured to put a tension force on the pin as the sleeve passes a predetermined temperature, for instance a temperature at which the shape memory feature of the sleeve is activated. The pin may have a weakened portion, such as a notched portion, at which the pin breaks. The breaking of the pin may be used to drive the firing pin into the primer, to initiate the detonation and/or combustion reaction.

The firing pin may be mechanically coupled to a linkage that prevents egress of output from the primer if the firing pin has not been moved. The linkage may include a cylindrical valve element with a through hole, the through hole being alignable with an output channel from the primer when the firing pin has been moved sufficiently. The movement of the firing pin slides a dowel pin that is attached to the firing pin. This in turn translates a cam element that turns the cylindrical element. Partial movement of the firing pin still may leave the valve closed. Preventing the primer from prematurely operating to trigger explosion, for example preventing full operation due to a primer being heated.

Figure 1:
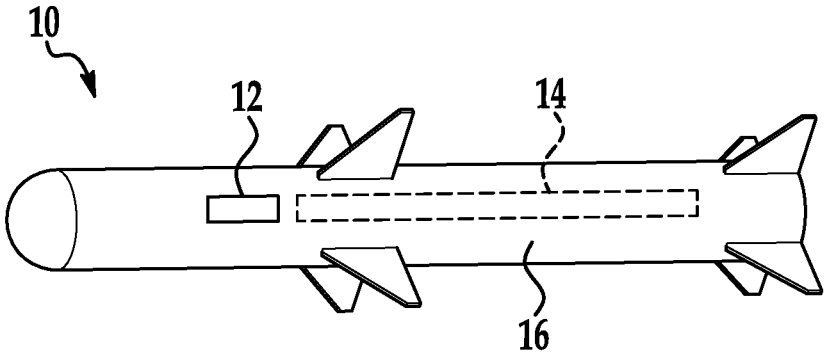
FIG. 1 is an oblique view of a munition that includes a triggering device in accordance with an embodiment of the invention.
Figure 2:
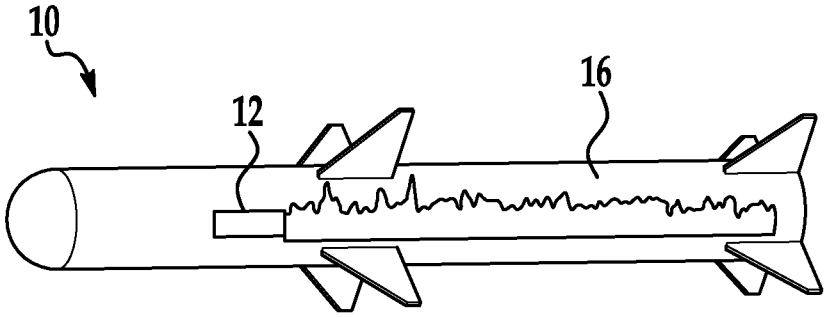
FIG. 2 is another oblique view of a munition that includes a triggering device in accordance with an embodiment of the invention.

FIGS. 1 and 2 show a missile or munition 10 that includes a triggering device 12, for triggering a shaped charge 14 for scoring a motor casing 16 of the missile 10. This is done to prevent firing of a rocket motor, or explosion of propellant, when the missile or munition is subjected to a slow cook-off event, for example a fire. Upon occurrence of a triggering event, such as reaching a predetermined elevated temperature, the triggering device 12 triggers detonation of the shaped charge 14, scoring and splitting the motor casing 16, as shown in FIG. 2. This prevents explosion or a propulsive event, which would be a safety hazard.

The triggering device 12 also needs to avoid detonation of the shaped charge 14 from other types of heating, for example avoiding triggering from aero-thermal heating during flight of the missile or munition 10. Accordingly the triggering device 12 may have one or more safety features to prevent undesired triggering of the shaped charge 14.

Figure 3:
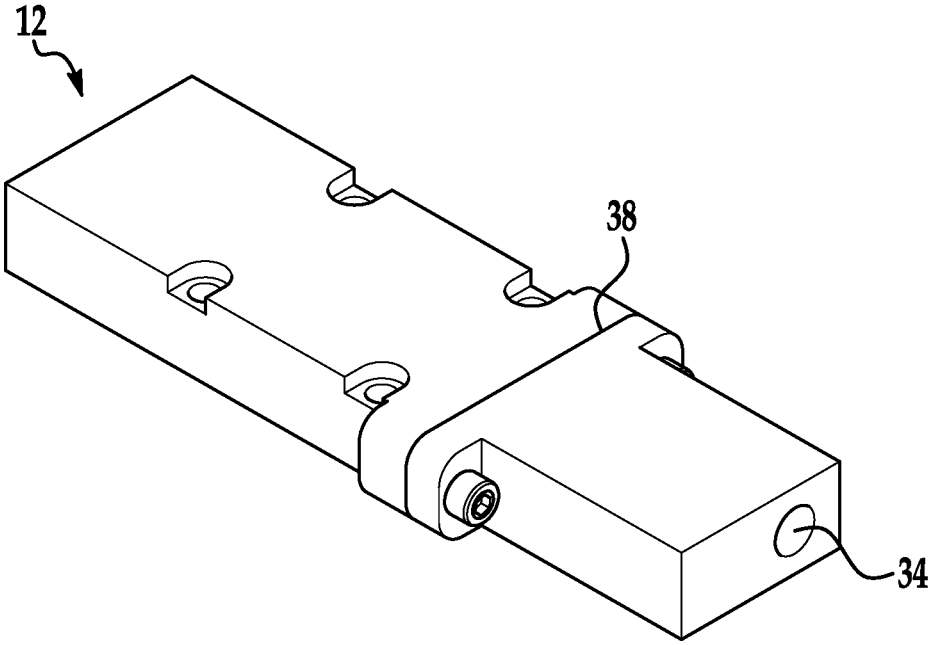
FIG. 3 is an oblique view of the triggering device of the munition of FIG. 1.
Figure 4:
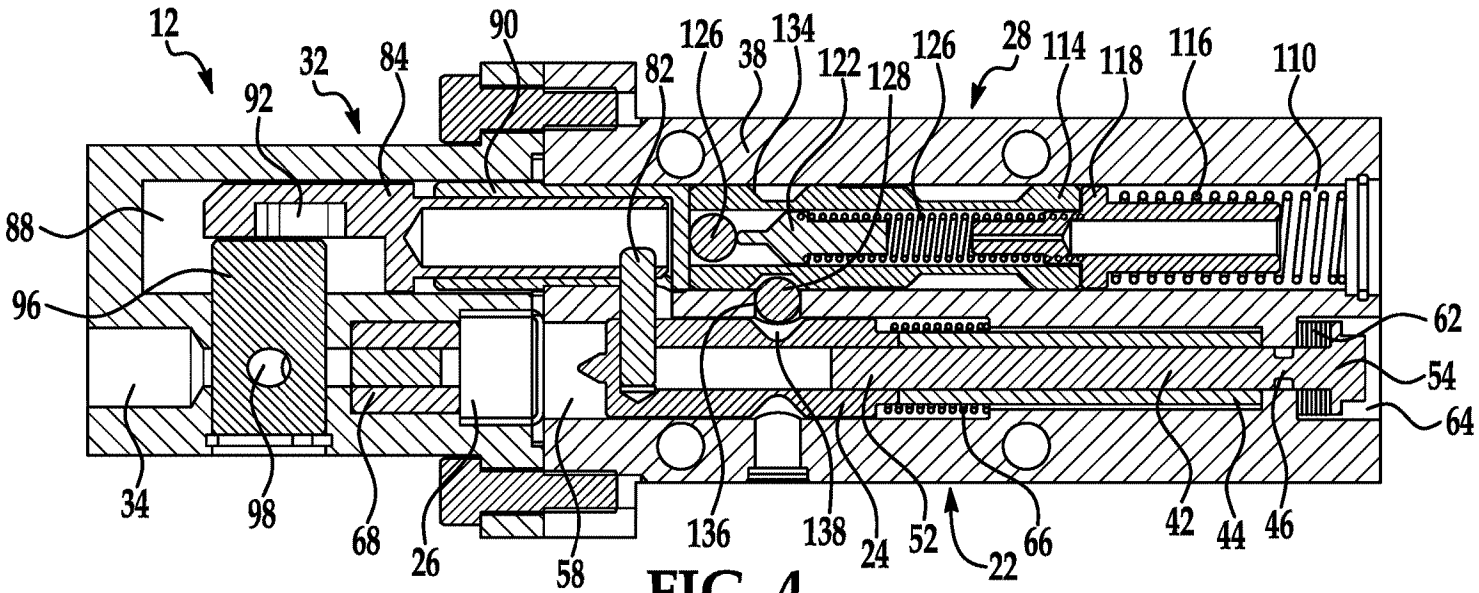
FIG. 4 is a sectional view of the triggering device of FIG. 3.

FIGS. 3 and 4 show some details of the triggering device 12. The device 12 has three general parts: a triggering element 22 which is used to move a firing pin 24 toward a primer 26; an inertial lock-out 28 used to prevent movement of the firing pin 24 once the missile 10 (FIG. 1) has been launched; and a linkage 32 that is used to selectively open or close a passageway (output port) 34 through which products from the primer 26 pass. The operative general parts are located within a casing 38.

The triggering element 22 includes a metal pin 42 made of a first metal, surrounded by a sleeve 44 made of a second metal that is different from the first metal. The term "metal," as used herein, should be interpreted broadly to include elemental metal, as well as metal alloys. The sleeve 44 is configured to put a force on the metal pin 42 when sufficient heat is applied. This force may be used break the pin 42 at a weakened portion 46 of the pin 42. In the illustrated embodiment the weakened portion 46 is a notched portion of the pin 42, but may be a portion otherwise having been thinned. For example a notch may be uniformly cut or otherwise formed around the pin 42 to create the weakened portion 46. The depth of the notch may be selected in order to cause the pin 42 to break at a predetermined temperature.

The sleeve 44 may be made of a shape memory alloy, such as a single-crystal shape memory alloy, such as a copper-aluminum alloy. The sleeve 44 may be pre-compressed against the pin 42, with a memory shape puts stresses against the pin 42. As the temperature rises, the sleeve 44 eventually passes its transition temperature, undergoing a phase transformation between different structures. This may occur, for example at around 160° C. The causes the sleeve 44 to produce a force tending to change its shape. This force is transmitted to the pin 42, for example placing a force on the pin 42 that causes a tension within the pin 42. This force may be used to sever the pin 42 at the weakened section or portion 46 of the pin 42, where the pin 42 preferentially breaks.

One end 52 of the pin 42 is secured to the firing pin 24, with the firing pin 24 being hollow and receiving the pin end 52. An opposite end 54 of the pin 42 extends out of a cavity 58 in which the firing pin 24 and the sleeve 44 are located. The pin end 54 compresses a stack of springs 62, such as a stack of Belleville washers, that is in a recess 64 in the casing 38. When the pin 42 breaks at the weakened portion 48, a force separates the portions of the metal pin on opposite sides of the weakened portion 46. This force comes mainly from the energy stored in the sleeve 44 that becomes kinetic energy pushing the pin end 52 and the firing pin 24 to slide within the cavity 58 toward the primer 26. In addition some of the force moving the pin end 52 and the firing pin 24 may come as a result of recoil from the breakage of the pin 42. The compressed springs 62 provide an even loading on the pin 42. This provides more consistency in the fracture temperature and the force of the firing pin 24.

A stay spring 66 is also located within the cavity 58, with the stay spring 66 being a coil spring that is between a ledge of the casing 38 bordering the cavity 58. One function of the stay spring 66 is to keep loose parts, such as the firing pin 24, from moving around within the cavity 58 after the breakage of the pin 42. The spring 66 may also function to provide an additional and/or back-up force to move the firing pin 24 toward the primer 26, after breakage of the pin 42.

The primer 26 is activated when impacted by the firing pin 24. This in turn may fire a booster 68 that produces detonation/combustion products, such as flames, hot gasses, and/or molten material. These products are described herein as being products of the detonation of the primer 26, even though the booster 68 is also involved in creating the products that exit the triggering element 22 to detonate the shaped charge 14 (FIG. 1).

Figure 5:
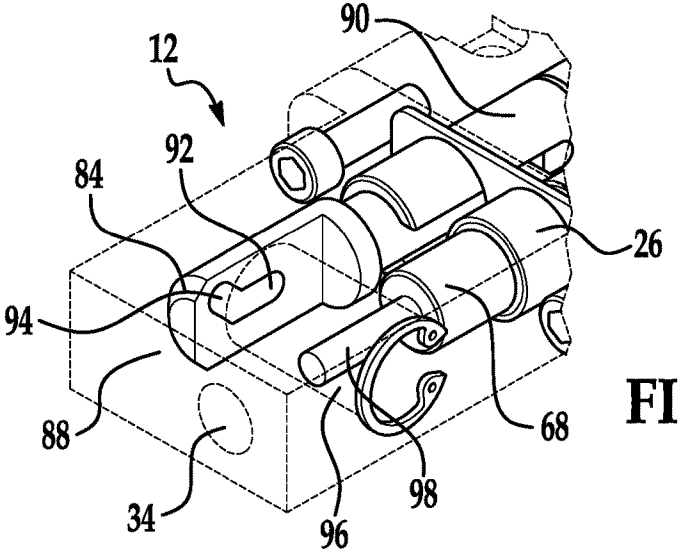
FIG. 5 is an oblique view showing some of the working parts of the triggering device of FIG. 3.

A dowel pin 82 is located in and moves with the firing pin 24, providing a mechanical connection between the triggering element 22 and the linkage 32. The dowel pin 82 links the firing pin 24 to a linking member 84 that in turn converts translational motion to rotational motion. The linking member 84 slides within a cavity 88 in the casing 38, and relative to a fixed sleeve 90 that is also within the cavity 88. With reference in addition to FIG. 5, the linking member 84 includes a cam slot 92 that receives a cam follower protrusion 94 on an end of a barrel valve 96. The barrel valve 96 has a through hole 98 that needs to be aligned with the outlet port 34 for output (hot gasses and other detonation products) to exit the device 12 through the outlet port 34. These products are used to detonate the shaped charge 14 (FIG. 1). The barrel valve 96 is used as a safety device to prevent exit of the detonation products unless the firing pin 24 has indeed been activated to move. The movement of the firing pin 24 moves in translation the dowel pin 82 and the linking member 84 as well. The movement of the linking member 84 causes rotation of the barrel valve 84 about the axis of the barrel valve 84. This occurs through the interaction of the cam slot 92 and the follower protrusion 94.

Figure 6:
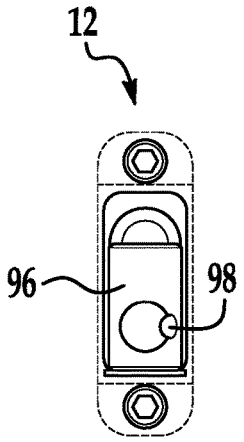
FIG. 6 is an end view of the triggering device of FIG. 3 in a first step in the triggering process.
Figure 7:
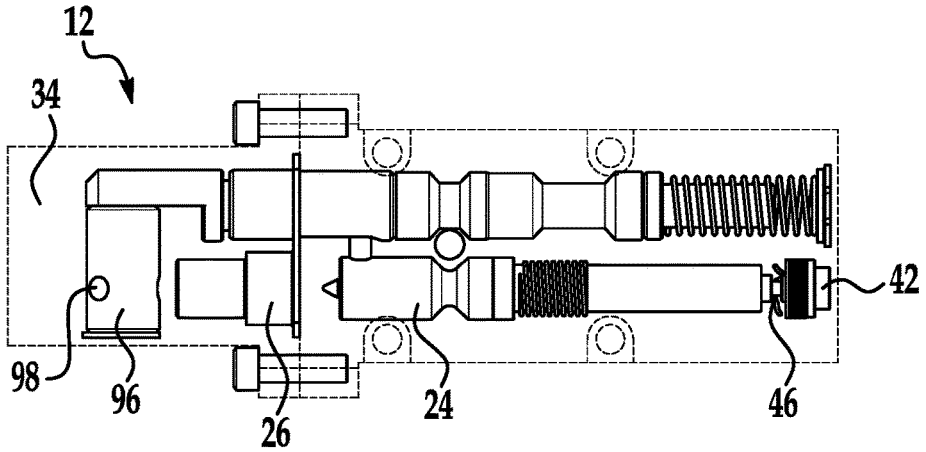
FIG. 7 is a side view of the triggering device of FIG. 3 in the first step in the triggering process.

FIGS. 6-11 show the process of triggering the device 12. FIGS. 6 and 7 show the device 12 in its initial safe state, before breakage at the weakened portion 46 of the pin 42. In this condition the barrel valve through hole 98 is not aligned at all with the outlet port 34, and the solid parts of the barrel valve 96 fully blocks the outlet port 34.

Figure 8:
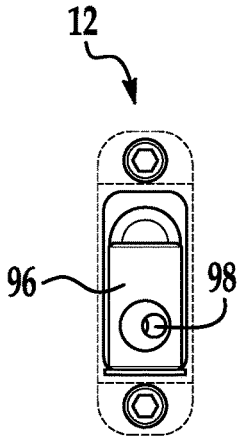
FIG. 8 is an end view of the triggering device of FIG. 3 in a second step in the triggering process.
Figure 9:
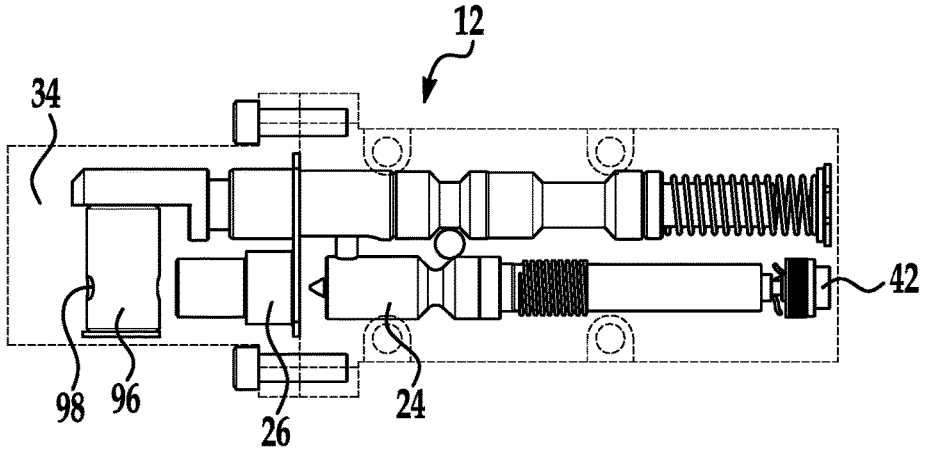
FIG. 9 is a side view of the triggering device of FIG. 3 in the second step in the triggering process.

FIGS. 8 and 9 shows an intermediate step, where the pin 42 has broken and the firing pin 24 has started to move. The barrel valve 96 has rotated to the point where the through hole 98 has begun to align with the outlet port 34. However the barrel valve 96 still mostly blocks the outlet port 34. The device 12 is thus still in a safe condition, with the primer 26 unable to detonate the shaped charge 14 (FIG. 1).

Figure 10:
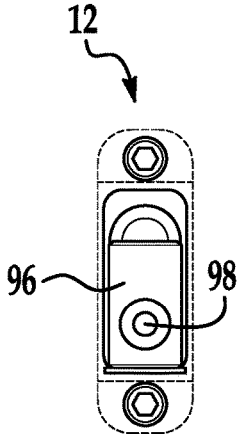
FIG. 10 is an end view of the triggering device of FIG. 3 in a third step in the triggering process.
Figure 11:
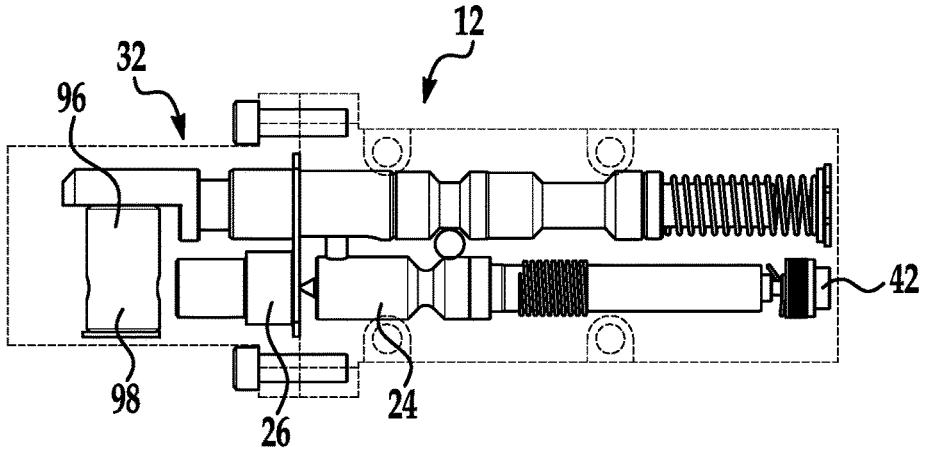
FIG. 11 is a side view of the triggering device of FIG. 3 in the third step in the triggering process.

FIGS. 10 and 11 show the situation just before the firing pin 24 impacts the primer 26. The linkage 32 has now turned the barrel valve 96 so that the through hole 98 is aligned with the outlet port 34. In this condition the products from the detonation of the primer 26 by the firing pin 24 can leave the casing 38 through the outlet port 34 to detonate the shaped charge 14 (FIG. 1).

Returning now to FIG. 4, the triggering device 12 also includes the inertial lock-out 28, which is used to prevent movement of the firing pin 24 once the missile 10 (FIG. 1) has been launched. The components of the lock-out 28 are in a cavity 110 of the device 12. The cavity 110 may be aligned with the cavity 88, although other orientations are possible.

The lock-out 28 includes an inertial mass 114 that is configured to shift its position in reaction to acceleration from the launch of the missile 10 (FIG. 1). The mass 114 moves against a spring force from a spring 116, which biases the position of the inertial mass 114 to one side of the cavity 110, in the illustrated embodiment against the fixed sleeve 90. The mass 114 is hollow, and has a damping orifice 118 inserted in one of its ends, between the mass 114 and the spring 116. The damping orifice 118 has air passages therethrough configured to control the movement of the inertial mass 114 through air resistance.

Other components are also within the hollow inside the inertial mass 114: a lockout plunger 122, a plunger spring 124, and a ball 126. A second ball 128 also initially partially rests in a groove 134 in the inertial mass 114. The second ball 128 also is initially in a hole 136 that is between the cavities 58 and 110, aligned with a groove 138 in the firing pin 24.

Inertia from the launch of the missile 10 (FIG. 1) causes the inertial mass 114 to move rightward in the diagram. The movement of the inertial mass 114 pushes the ball 128 out of the inertial mass groove 134 and into the firing pin groove 138. The rightward movement of the inertial mass 114 also allows the ball 126 to emerge from the central hollow of the inertial mass 114, being pushed by a tip of the lockout plunger 122, under the force of the plunger spring 124. The ball 126 drops down in the space left by movement of the inertial mass 114, blocking the inertial mass 114 from returning to its original position. This blockage of return movement of the inertial mass 114 keeps the ball 128 engaged in and indeed locked in the firing pin groove 138. This prevents movement of the firing pin 24, thereby also preventing the firing pin 24 from engaging the primer 26.

Many variations are possible, in that some of the features described above may be modified or in some instance omitted altogether. For instance the inertial lock-out 28 (FIG. 4) may have a different configuration than what is shown. Alternatively or in addition the linkage 32 (FIG. 4) may have a different configuration, or may be omitted altogether. In the latter case the outlet port 34 (FIG. 4) may allow passage of detonation/combustion products without any blockage. Alternatively a differently-configured safety device may be employed in the outlet port 34.

Figure 12:
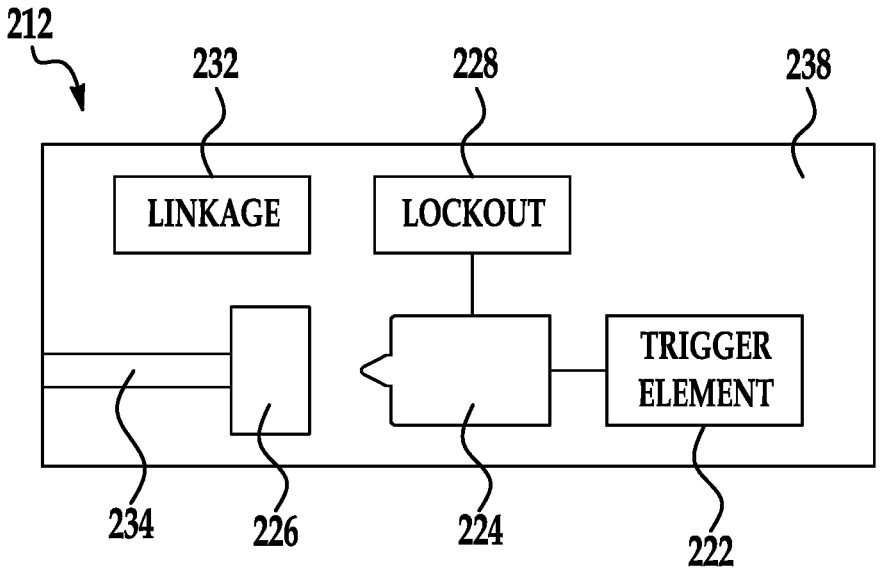
FIG. 12 is a schematic diagram of an alternate embodiment triggering device of the present invention.

FIG. 12 shows a generalized alternative embodiment triggering device 212, with a trigger element or mechanism 222 used to move a firing pin 224 toward a primer 226; an inertial lockout 228 used to prevent movement of the firing pin 224 once the missile has been launched; and a linkage 232 that is used to selectively open or close a passageway (output port) 234 through which products from the primer 226 pass. The operative general parts are located within a casing 238.

The parts or elements 222, 228, and 232 may have different configurations from those described earlier with regard to the triggering device 12 (FIG. 4). The trigger element 222 may provide other sorts of forces for selectively moving the firing pin 224 when a temperature threshold is reach, for example by using a shape memory alloy spring. The inertial lockout 228 may have other forms for locking out movement of the firing pin 224 when the missile or munition accelerates during launch or flight, for example utilizing mechanical lockout mechanisms other than that in the lockout 28 (FIG. 4). The linkage 232 may use any of a variety of mechanical components, such as sliding elements, pivoting elements, and/or rotating elements, such as gears or cams/followers, coupled together in any of a variety of suitable ways to mechanically link the firing pin 224 to a valve (of any of a variety of sorts) that selectively allows detonation/combustion products to exit the device 212.

Figure 13:
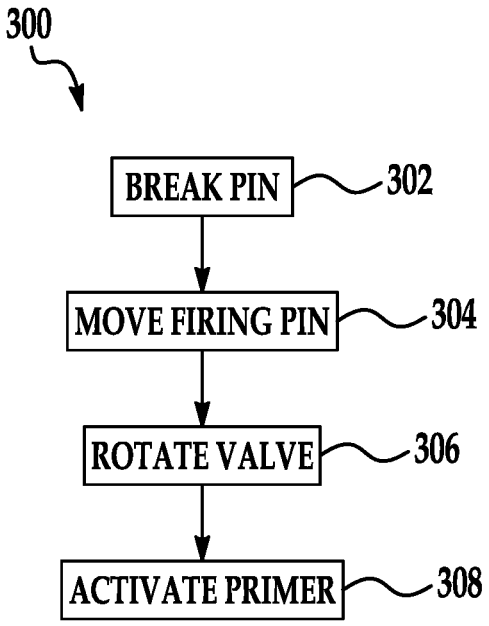
FIG. 13 is a high-level flow chart of steps in the operation of the triggering device of FIG. 3.

In operation, with reference now in addition to FIG. 13, a method 300 of firing the triggering device 12 (FIG. 1) begins in step 302 with the device 12 being heated until the forces from the sleeve 44 (FIG. 4) cause the metal pin 42 (FIG. 4) to break, such as at the notched or weakened portion 46 (FIG. 4).

In step 304 the breakage of the pin 42 (FIG. 4) causes the firing pin 24 (FIG. 4) to move toward the primer 26 (FIG. 4). At the same time, in step 306, the movement of the firing pin 24 acts through the linkage 32 (FIG. 4) to rotate the barrel valve 96 (FIG. 4), eventually opening the valve 96. Finally in step 308 the firing pin 24 strikes the primer 26 (FIG. 4), resulting in detonation products from the primer 26 and the booster 68 (FIG. 4) exiting the triggering device 12 (FIG. 1) through the outlet port 34 (FIG. 4).

The triggering devices 12 and 212 provides many advantages over prior devices. The linkage between the firing pin 24 (FIG. 4) and the valve 96 (FIG. 4) provides a robust safety device, low in cost and reliable in operation, for preventing undesired triggering of the shaped charge 14 (FIG. 1).

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A triggering device comprising:

a firing pin configured to impact a primer;

a linkage; and a valve mechanically coupled to the firing pin via the linkage, wherein the valve selectively allows output from firing of the primer to pass to an output port of the triggering device based on movement of the firing pin acting through the linkage to open the valve.

2. The triggering device of claim 1, wherein the valve is a barrel valve with a through hole that selectively lines up with a passage between the firing pin and the output port.

3. The triggering device of claim 2, wherein the barrel valve rotates to align with the passage just as the firing pin reaches the primer.

4. The triggering device of claim 1, wherein the valve is a barrel valve, with a through hole that selectively lines up with a passage between the firing pin and the output port; and wherein the linkage includes a linking member that translates along with movement of the firing pin, and a cam mechanism that interacts with the linking member to convert translation of the linking member to rotation of the barrel valve.

5. The triggering device of claim 4, wherein the linkage further includes a dowel pin coupling together the firing pin and the linking member.

6. The triggering device of claim 4, wherein the linking member has a slot therein that receives a follower of the barrel valve.

7. The triggering device of claim 6, wherein the slot is substantially parallel to a direction of travel of the linking member.

8. The triggering device of claim 4, wherein the triggering device further comprises a casing that defines cavities including a first cavity and a second cavity that are parallel to one another; and wherein the linking member moves in the first cavity and the firing pin moves in the second cavity.

9. The triggering device of claim 1, further comprising a lockout configured to selectively prevent movement of the firing pin.

10. The triggering device of claim 9, wherein the valve is a barrel valve, with a through hole that selectively lines up with a passage between the firing pin and the output port;

wherein the linkage includes a linking member that translates along with the firing pin, and a cam mechanism that converts translation of the linking member to rotation of the barrel valve; and wherein the lockout includes an inertial mass that moves in a recess coaxial with a recess in which the linking member is located.

11. A munition including the triggering device of claim 1, a primer operatively coupled to the firing pin, and a shaped charge, wherein the triggering device is operatively coupled to the shaped charge of the munition such that detonation products from the primer detonates the shaped charge.

12. A method of operating a triggering device including a firing pin, a primer, a linkage, and a barrel valve, the method comprising:

moving the firing pin toward the primer; and the movement of the firing pin rotating the barrel valve through the action of the linkage mechanically coupling the firing pin and the barrel valve.

13. The method of claim 12, wherein a through hole of the barrel valve aligns with an output passage and an outlet port of the triggering device, as the firing pin reaches the primer; and further comprising expelling output from firing of the primer through the outlet port.

14. The method of claim 12, wherein the rotating the barrel valve includes a follower on the barrel valve moving in a slot of a linking member that translates along with the firing pin.

15. The method of claim 14, wherein the linking member translates in a first passage of a housing of the triggering device and the firing pin translates in a second passage of the housing, with moving of the firing pin moving the linking member and a dowel pin that connects together the firing pin and the linking member.

* * * * *